United States Patent [19]

Shuert

[11] Patent Number: 4,742,781

[45] Date of Patent: May 10, 1988

[54] TWIN SHEET PALLET WITH SLEEVE RETAINING CONSTRUCTION

[76] Inventor: Lyle H. Shuert, 817 Fieldstone, Rochester, Mich. 48063

[21] Appl. No.: 4,266

[22] Filed: Jan. 9, 1987

Related U.S. Application Data

[63] Continuation of Ser. No. 677,603, Dec. 3, 1984, abandoned.

[51] Int. Cl.[4] ..... B65D 19/18

[52] U.S. Cl. ..... 108/53.3; 108/57.1/901; 206/600

[58] Field of Search ..... 108/53.1, 901, 53.3, 108/902, 57.1; 206/386, 600, 597, 599

[56] References Cited

U.S. PATENT DOCUMENTS

| | | | |
|---|---|---|---|
| 3,604,368 | 9/1971 | Baxter | 108/901 X |
| 3,636,888 | 1/1972 | Augelbeck, Jr. | 108/901 X |
| 3,699,902 | 10/1972 | Allgeyer et al. | 108/901 X |
| 4,000,704 | 1/1977 | Griffin, Jr. | 108/53.1 |
| 4,254,873 | 3/1981 | Cook, III et al. | 108/53.1 X |
| 4,413,737 | 11/1983 | Wind | 108/53.1 X |
| 4,516,677 | 5/1985 | Rowland et al. | 108/53.1 X |

*Primary Examiner*—Kenneth J. Dorner
*Assistant Examiner*—Thomas A. Rendos
*Attorney, Agent, or Firm*—Krass & Young

[57] ABSTRACT

A twin sheet pallet comprising a lower sheet having a substantially continuous downwardly opening U-shaped groove extending around its periphery for stacking receipt of the upper edge portion of the sleeve of a lower container, and an upper sheet having a substantially continuous upwardly opening U-shaped groove extending around its periphery for stacking receipt of an upper container sleeve which at least portions of the peripheral undersurface of the upper sheet underlying the upwardly opening groove bonded to at least portions of the peripheral upper surface of the lower sheet overlying the downwardly opening groove to form a unitary twin sheet pallet. The upwardly opening groove in the upper sheet is stepped upwardly at circumferentially spaced locations about that groove and an opening is provided in the outer wall of the upper sheet in alignment with each upward step to allow passage of the forks of a forklift truck.

9 Claims, 3 Drawing Sheets

TWIN SHEET PALLET WITH SLEEVE RETAINING CONSTRUCTION

This is a continuation of co-pending application Ser. No. 677,603 filed on Dec. 3, 1984, now abandoned.

BACKGROUND OF THE INVENTION

This invention relates to shipping and storage pallets and more particularly to plastic pallets embodying a twin sheet construction.

Pallets have traditionally been formed of wood. Wood pallets, however, have many disadvantages. For example, they are subject to breakage and thus are not reusable over an extended period of time. Wood pallets also take up a considerable amount of valuable floor space in the warehouse when they are not in use. In an effort to solve some of the problems associated with wood pallets, plastic pallets have been employed with some degree of success. In one generally successful form of plastic pallet design, a twin sheet construction has been used in which upper and lower plastic sheets are formed in separate molding operations and the two sheets are then selectively fused or knitted together in a suitable press to form a reinforced double wall structure. Even these twin sheet plastic pallets have drawbacks however. For example, when used, as is common, as the base for a cardboard sleeve to form an open top container, the containers are difficult to stack for storage purposes and, once stacked, produce an ungainly and unstable assembly. Further, the prior art twin sheet pallets fail to make provision to preclude tipping of the pallet off of the forks of a forklift truck in the presence of an unbalanced load on the pallet.

SUMMARY OF THE INVENTION

The invention is directed to the provision of a plastic pallet which is particularly suited for stacking containers without a top pallet.

The invention twin sheet pallet in its broadest aspect comprises a lower sheet having a substantially continuous downwardly opening U-shaped groove extending around its periphery for stacking receipt of the upper edge portion of the sleeve of a lower container, and an upper sheet having a substantially continuous upwardly opening U-shaped groove extending around its periphery for stacking receipt of the lower edge portion of an upper container sleeve. At least portions of the peripheral undersurface of the upper sheet underlying the upwardly opening groove are bonded to at least portions of the peripheral uppersurface of the lower sheet overlying the downwardly opening groove to form a unitary twin sheet pallet. The invention pallet thus facilitates the stacking of open top containers, one on top of another, in a stable manner.

According to a further feature of the invention, the upwardly opening groove in the upper sheet is stepped upwardly at circumferentially spaced locations about that groove and an opening is provided in the outer wall of the upper sheet in alignment with each upward step to allow passage of the forks of a forklift truck. Since the forks are thus trapped between the upper peripheral surface of the lower sheet and the surfaces of the upper sheet under the steps, the pallet is resistant to tipping off of the forks even in the presence of an unbalanced load.

DETAILED DESCRIPTION OF THE PREFERRED EMBODIMENT

The broad inventive aspects of the invention twin sheet pallet are illustrated in FIGS. 1–3 and 6.

Figure 1:
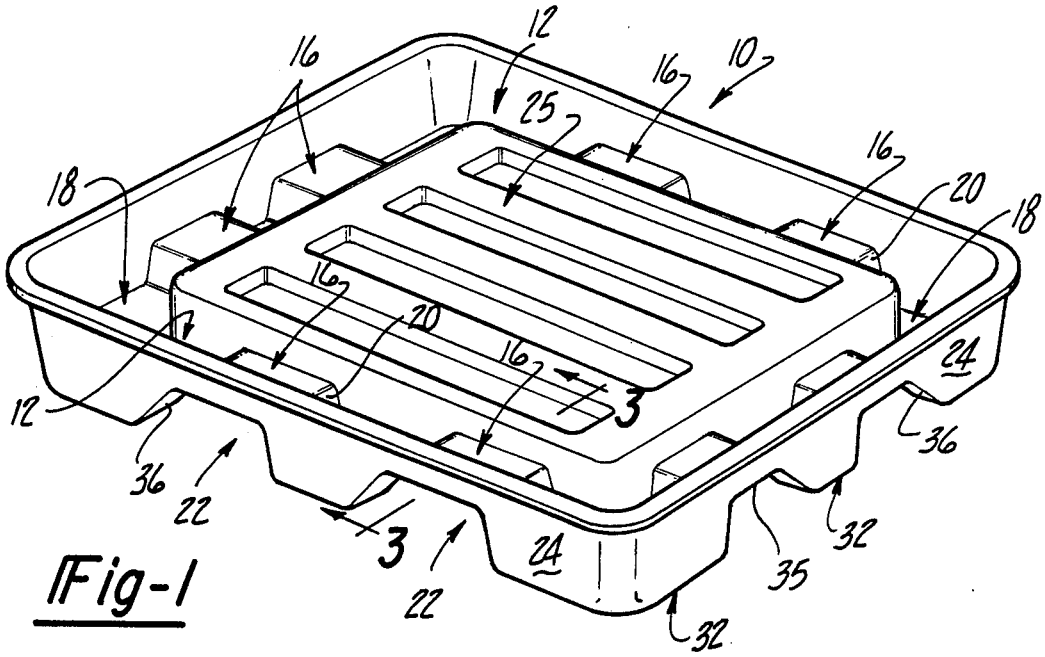
FIG. 1 is a somewhat schematic perspective view of the upper sheet of the invention twin sheet pallet.

The upper plastic sheet 10 seen in FIG. 1 is molded to define a substantially continuous upwardly opening U-shaped groove 12 extending around the periphery of the sheet for stacking receipt of the lower edge portion of an upper container sleeve 14. Groove 12 is stepped upwardly at circumferentially spaced locations about the groove to define steps 16 interconnected with the unstepped portions 18 of the groove by angled risers 20, and an opening 22 is provided in the outer wall 24 of the upper sheet in alignment with and immediately beneath each step 16. The lower edge of sleeve 14 would of course be complementarily stepped so that the sleeve would seat contiguously with respect to surfaces 16, 18 and 20.

Figure 2:
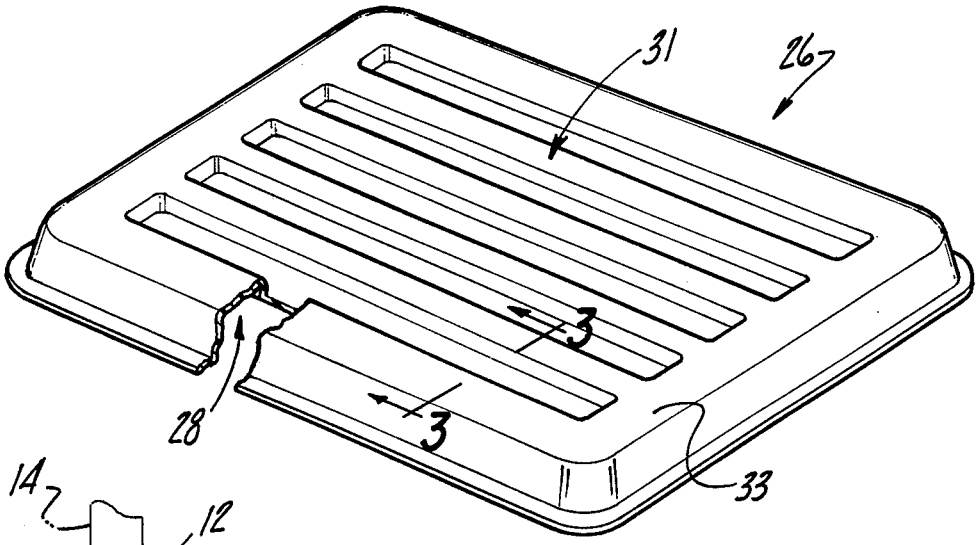
FIG. 2 is a somewhat schematic perspective view of the lower sheet of the invention twin sheet pallet.

The lower plastic sheet 26 seen in FIG. 2 is molded to provide a substantially continuous downwardly opening U-shaped groove 28 for stacking receipt of the upper edge portion of the sleeve 30 of a lower container. Lower sheet 26 is configured to provide a plurality of parallel stiffening ribs 31.

Sheets 10 and 26 may comprise sheets of a suitable organic polymeric material such as polyethylene and may be molded in a vacuum forming process.

Figure 3:
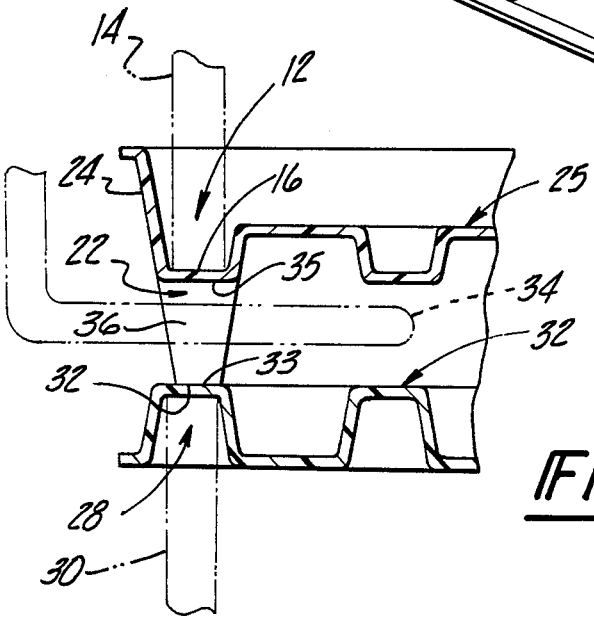
FIG. 3 is a fragmentary cross-sectional view taken on lines 3—3 of FIGS. 1 and 2.
Figure 6:
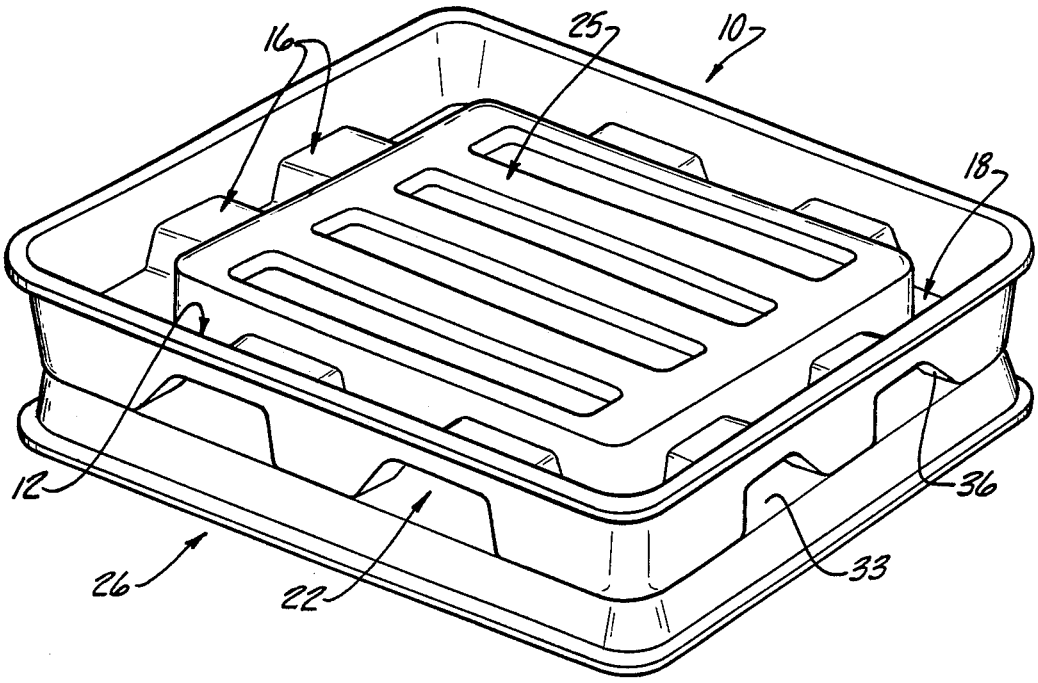
FIG. 6 is a somewhat schematic perspective view showing the upper sheet of FIG. 1 fused to the lower sheet of FIG. 2 to form the invention twin sheet pallet.

Upper sheet 10 is bonded to lower sheet 26 in a compression molding process to fuse or knit together the upper and lower sheets at their various interfaces. Specifically, the peripheral undersurfaces 32 of the upper sheet underlying the unstepped portions 18 of groove 12 are knitted to the juxtaposed portions of the peripheral upper surface 33 of the lower sheet overlying groove 28 to form a rigid unitary twin sheet pallet. The completed pallet, as best seen in FIGS. 3 and 6, provides a lower groove 28 for stacking receipt of the sleeve 30 of a lower container; provides an upper groove 12 for stacking receipt of upper container sleeve 14, and provides openings or pockets 22 underlying steps 16 for receipt of the forks 34 of a forklift truck. Forks 34 are trapped vertically between surface 33 and surfaces 35 underlying steps 16, and laterally between the surfaces 36 underlying risers 20, to preclude slippage of the pallet off of the forks even in the presence of an unbalanced load on the pallet.

Figure 4:
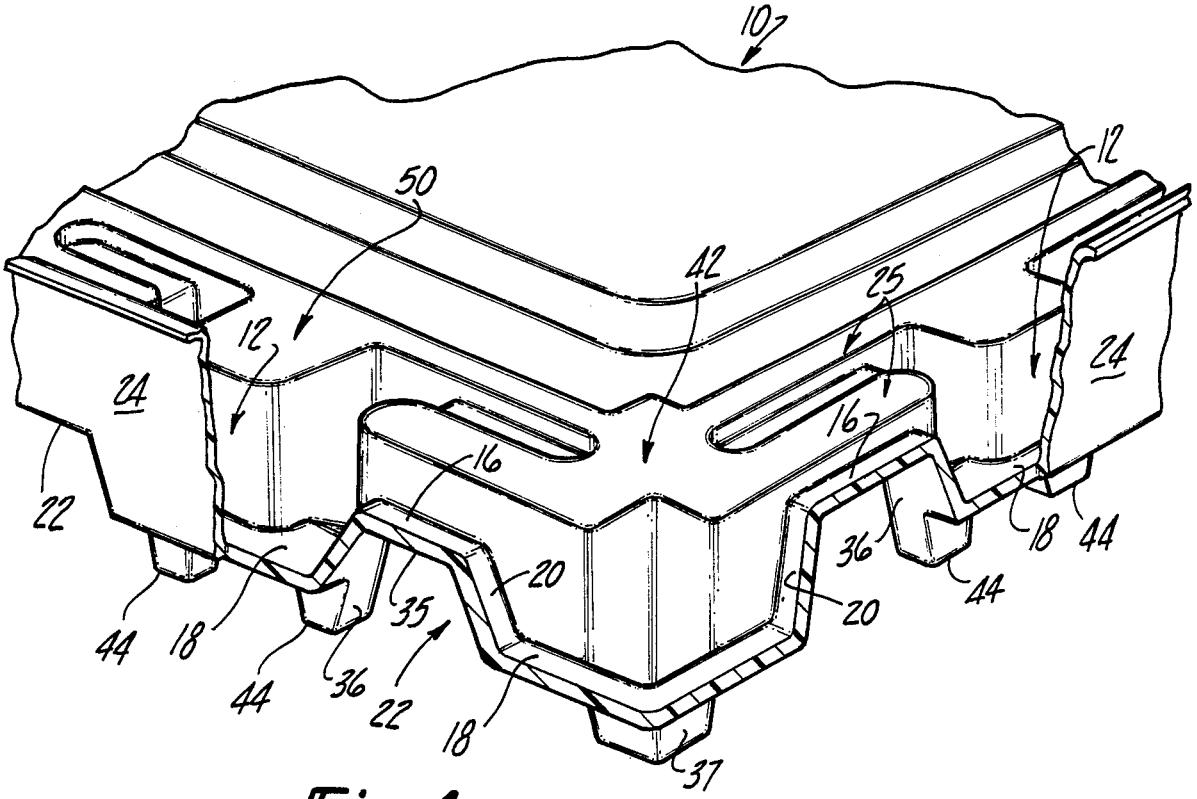
FIG. 4 is fragmentary perspective view of a particular commercial embodiment of the upper pallet sheet.
Figure 5:
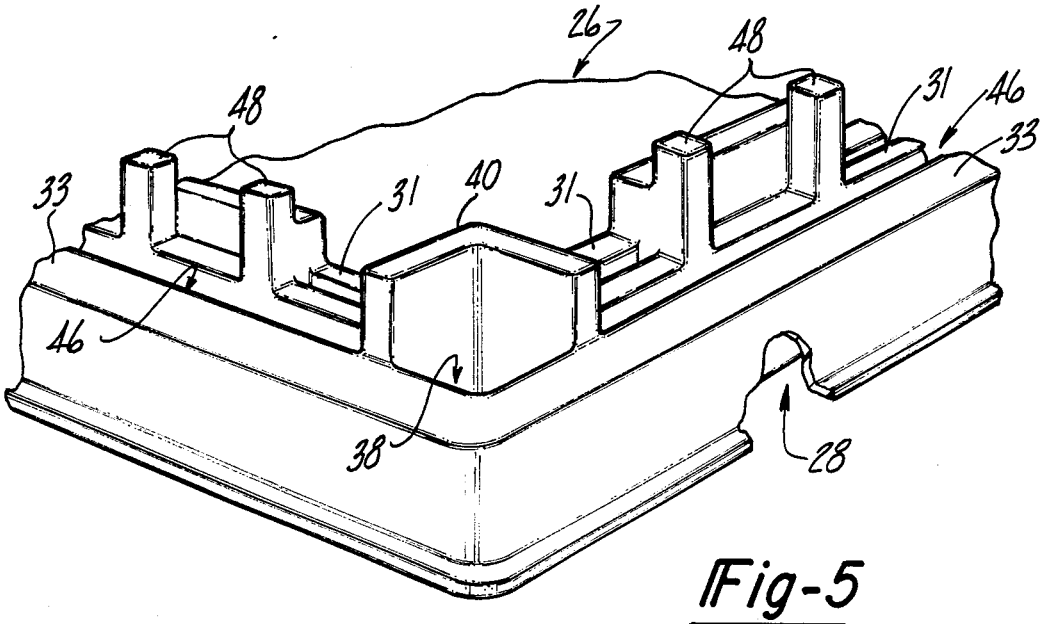
FIG. 5 is a perspective fragmentary view of a lower pallet sheet for use with the upper pallet sheet of FIG. 4.

Whereas the basic inventive concepts of the invention twin sheet pallet are illustrated in FIGURES 1–3 and 6, in actual commercial practice the upper and lower sheets 10 and 26 would typically be configured and convoluted, as seen in the commerical embodiment of FIGS. 4 and 5, to provide an intricate interlocking relationship between the upper and lower sheets to form a rigid and durable pallet. For example, the upper sheet 10, as seen in FIG. 4, while retaining the continuous peripheral groove 12 with its steps 16, unstepped portions 18, and angled risers 20, is intricately convoluted, particularly along its peripheral portions inboard of groove 12, to form a multi-level structure intended to fit in jigsaw puzzle fashion over the lower sheet 26.

Similarly, lower sheet 26, as seen in FIG. 5, while retaining the continuous downwardly opening U-shaped peripheral groove 28 and stiffening ribs 31, is intricately convoluted, particularly along its peripheral portions inboard of groove 28, to provide a multi-level structure intended to interfit with the multi-level structure of the upper sheet 10.

Specifically, upper sheet 10 includes downwardly projecting hollow corner feet 37 which nest in pockets 38 provided at each corner of lower sheet 26; lower sheet 26 at each corner includes right angle upstanding downwardly opening hollow walls 40 which nest in complementarily shaped downwardly opening tower structures 42 at each corner of upper sheet 10; upper sheet 10 includes downwardly projecting hollow feet 44 intermediate each side of the sheet which nest in longitudinally and laterally extending grooves 46 formed in lower sheet 26 between reinforcing ribs 31 and the peripheral edge portions 33 of the sheet; and lower sheet 26 is molded to provide twin hollow downwardly opening tower structures 48 intermediate each side of the sheet which are nestingly received in a hollow downwardly opening tower structure 50 provided along each side of upper sheet 10. Although the central portions of the upper and lower sheets are shown as being substantially planar, in actual practice it will be understood that these sheets are also selectively convoluted to provide knitting interaction between the upper and lower sheets in their central regions. When the upper sheet 10 of FIG. 4 is fitted over the lower sheet 26 of FIG. 5 and the two sheets are fused together in a compression molding process, the material of the two sheets fuses at each interface to form double thickness material walls and the two sheets are firmly and inextricably molded together to form a rigid unitary pallet. As with the schematic pallet of FIGS. 1–3 and 6, the pallet of FIGS. 4 and 5 provides a continuous, stepped, upwardly opening groove 12 for receipt of the lower edge portion of an upper container sleeve 14; provides a continuous downwardly opening groove 28 for receipt of the upper edge portion of a lower container sleeve 30; and provides a pair of openings or pockets 22 along each side of the pallet for trapping receipt of the forks 34 of a forklift truck.

Although a preferred embodiment of the invention has been illustrated and described in detail, it will be apparent that various changes may be made in the disclosed embodiment without departing from the scope or spirit of the invention.

I claim:

1. A twin sheet pallet comprising:

(A) a lower sheet configured around its periphery to define an upwardly extending peripheral wall portion blending in sheet form at its upper edge into a laterally outwardly extending wall portion blending in turn in sheet form at its outer edge into a downwardly extending peripheral wall portion, said wall portions coacting to define a substantially continuous downwardly opening U-shaped groove extending around the periphery of said lower sheet for stacking receipt of the upper edge portion of a lower container sleeve;

(B) an upper sheet configured around its periphery to define a downwardly extending peripheral wall portion blending in sheet form at its lower edge into a laterally outwardly extending wall portion blending in turn in sheet form at its outer edge into an upwardly extending peripheral wall portion, said wall portions coacting to define a substantially continuous upwardly opening U-shaped groove extending around the periphery of said upper sheet for stacking receipt of the lower edge portion of an upper container sleeve;

(C) at least portions of the peripheral undersurface of said laterally outwardly extending peripheral wall portion of said upper sheet being bonded to at least portions of the peripheral upper surface of said laterally outwardly extending peripheral wall portion of said lower sheet to form a unitary twin sheet pallet; and (D) said downwardly opening U-shaped groove directly underlying said upwardly opening U-shaped groove and generally corresponding in size and shape to said upwardly opening U-shaped groove.

2. A twin sheet pallet according to claim 1 wherein:

(d) said laterally outwardly extending peripheral wall portion of said upper sheet is stepped upwardly at circumferentially spaced locations about said upwardly opening groove and an opening is provided in said upwardly extending peripheral wall portion of said upper sheet in alignment with each upward step to allow passage of the forks of a forklift truck.

3. A twin sheet pallet according to claim 2 wherein:

(e) each of said sheets is rectangular;

(f) said laterally outwardly extending peripheral wall portion of said upper sheet is stepped upwardly twice along each side of said upper sheet; and (g) an opening is provided in said upwardly extending peripheral wall portion of said upper sheet in alignment with each upward step so that the two forks of a forklift truck may be inserted into any of the four sides of the pallet.

4. A method of forming a twin sheet plastic pallet comprising the steps of:

(A) molding a lower plastic sheet to provide a substantially continuous downwardly opening U-shaped groove extending around its periphery and defined by an upwardly extending peripheral wall portion blending in sheet form at its upper edge into a laterally outwardly extending wall portion blending in turn in sheet form at its outer edge into a downwardly extending peripheral wall portion;

(B) molding an upper plastic sheet to provide a substantially continuous upwardly opening U-shaped groove extending about its periphery and generally corresponding in size and configuration to said downwardly opening U-shaped groove and defined by a downwardly extending peripheral wall portion blending in sheet form at its lower edge into a laterally outwardly extending wall portion blending in turn in sheet form at its outer edge into an upwardly extending peripheral wall portion;

(C) positioning said upper sheet over said lower sheet with the peripheral undersurface of said laterally outwardly extending wall portion of said upper sheet overlying the upper surface of said laterally outwardly extending portion of said lower sheet; and (D) bonding said sheets together at their interfaces to form a unitary pallet providing an upwardly opening circumferential groove at its top side and a downwardly opening circumferential groove at its bottom side directly underlying said upwardly opening groove and generally corresponding in size and configuration to said upwardly opening groove.

5. The method of claim 4 wherein:

(E) said upwardly extending peripheral wall portion of said upper sheet constitutes the outer side wall of said upper sheet; and (F) said upper sheet is molded to provide upward steps in said upwardly opening groove and an opening in said outer side wall of the sheet in alignment with and immediately beneath each upward step whereby, when the upper and lower sheets are bonded as aforedescribed, pockets are formed along the sides of the pallet for trapping receipt of the forks of a forklift truck.

6. The method of claim 5 wherein:

F. said upper sheet is molded along its periphery inboard of said upwardly opening groove to provide feet extending downwardly below the peripheral undersurface underlying said upwardly opening grooves; and G. said lower sheet is molded along its periphery inboard of said downwardly opening groove to provide upwardly opening pockets for nesting and fusing receipt of said feet.

7. The method of claim 6 wherein:

H. said lower sheet is molded along its periphery inboard of said downwardly opening groove to provide downwardly opening tower structures extending upwardly above the level of the lower sheet surface overlying that groove; and I. said upper sheet is molded along its periphery inboard of said upwardly opening groove to provide hollow downwardly opening tower structures for nesting and fusing receipt of the tower structures on said lower sheet.

8. A rigid unitary pallet for use with an open top container of the type including a pallet and a container sleeve supported on the pallet, said pallet comprising:

(A) a central portion defining a floor for the container; and (B) a peripheral portion extending around said central portion and defining a U-shaped upwardly opening groove on the upper face of said pallet for receipt of the lower edge portion of the container sleeve and a U-shaped downwardly opening groove in the lower face of said pallet for receipt of the upper edge portion of the container sleeve of a lower container, said downwardly opening groove generally corresponding in size and configuration to said upwardly opening groove and directly underlying said upwardly opening groove with at least portions of the top wall of said downwardly opening groove constituted by the bottom wall of said upwardly opening groove.

9. A pallet according to claim 8 wherein:

(c) said central portion includes an upper sheet defining said floor and a lower sheet spaced between said upper sheet;

(d) said peripheral portion includes an outer side wall defining the outer perimeter of said grooves; and (f) openings are provided in said outer side wall communicating laterally inwardly with the space between said upper and lower sheets to allow passage of the forks of a forklift truck through said openings and into said space.

* * * * *